United States Patent [19]

Cleusix

[11] Patent Number: 4,465,381

[45] Date of Patent: Aug. 14, 1984

[54] TIMEPIECE WITH MODULAR ALARM ACTIVATING MECHANISM

[75] Inventor: Willy Cleusix, Le Landeron, Switzerland

[73] Assignee: Ebauches Electroniques S. A., Marin, Switzerland

[21] Appl. No.: 352,622

[22] Filed: Feb. 26, 1982

[30] Foreign Application Priority Data

Feb. 26, 1981 [CH] Switzerland ..... 1319/81

[51] Int. Cl.[3] ..... G04C 21/16

[52] U.S. Cl. ..... 368/250; 368/73; 368/254

[58] Field of Search ..... 368/250, 252, 254, 257, 368/259, 260, 265, 266, 272, 72–75

[56] References Cited

U.S. PATENT DOCUMENTS

| | | | |
|---|---|---|---|
| 3,534,543 | 10/1970 | Assmus et al. | 368/250 |
| 4,000,384 | 12/1976 | Kumazawa | 368/250 |
| 4,069,658 | 1/1978 | Ito | 368/254 |
| 4,098,071 | 7/1978 | Kawakami et al. | 58/39 |
| 4,196,583 | 4/1980 | Komaki | 368/73 |
| 4,199,930 | 4/1980 | Lebet et al. | 368/252 |
| 4,351,043 | 9/1982 | Ogihara et al. | 368/252 |
| 4,371,267 | 2/1983 | Ogihara et al. | 368/254 |

*Primary Examiner*—Bernard Roskoski

*Attorney, Agent, or Firm*—Pollock, Vande Sande & Priddy

[57] ABSTRACT

The present invention concerns a timepiece having an alarm activating mechanism that serves for effecting the closure of an electrical contact (5a, 9) at a time which is adjustable in advance. The mechanism is arranged in the form of a module (100) which comprises a mechanically unitary assembly formed of two coaxial wheels (6, 8), one of which carries a contact element (9). This unitary assembly is mounted on the framework of the movement so that its angular position is manually adjustable about an axis, and it carries a wheel (5) which is in mesh with the hour wheel (3) and has an embossment (5a) which can enter into contact with the contact element (9). The invention is applicable more particularly to alarm watches.

13 Claims, 4 Drawing Figures

TIMEPIECE WITH MODULAR ALARM ACTIVATING MECHANISM

FIELD OF THE INVENTION

The present invention relates to a timepiece having a movement for driving time displaying members such as hands, and an activating mechanism for effecting the closure of an electrical contact at a time that can be set in advance.

BACKGROUND ART

An alarm watch of this type is disclosed by Swiss Pat. No. 526,154 which shows a watch having a mechanism for activating an electrical contact. One of the members of this electrical contact is a projection on a metal arm formed integrally with a sleeve which is engaged as a force fit on the pipe of the hour cannon wheel of the watch. The other contact member is carried by an electrically insulating wheel which is coaxial with the time-indicating hands. A spring urges said insulating wheel against said projection on the said metal arm. This known construction is difficult to assemble.

BRIEF SUMMARY OF THE INVENTION

An object of the invention is to avoid the difficulties of assembly experienced with prior art watches of this type.

In accordance with the invention, one of the contact members is mounted on a second support which is itself rotatably mounted on a first support carrying the other electrical contact member. The first support is mounted on a framework for rotation about an axis coincident with the axis of rotation of the second support. This axis is advantageously spaced aside from the axis of the time displaying members. The first support can advantageously comprise means for axially securing of the second support in order to avoid any unwanted disassembly of the latter from the first support. Thus the two supports form an inseparable modular assembly which facilitates the assembly of the timepiece.

According to a preferred constructional embodiment, the first support comprises two wheels which are coaxial and integral with each other and the second support is a third wheel mounted with axial play between the wheels of the first support. One of the wheels of the first support is made of an electrically insulating material; and carries one of the contact members. This same wheel is rotatably mounted in a bearing in the framework and is operatively connected to a time-setting means. The other wheel of the first support is meshed with a wheel having a pipe carrying a hand that indicates the time at which the contact will close.

BRIEF DESCRIPTION OF THE DRAWINGS

The invention will be better appreciated from the following description of two embodiments given by way of example, with reference to the accompanying drawings in which.

DETAILED DESCRIPTION OF THE PREFERRED EMBODIMENTS

Figure 1:
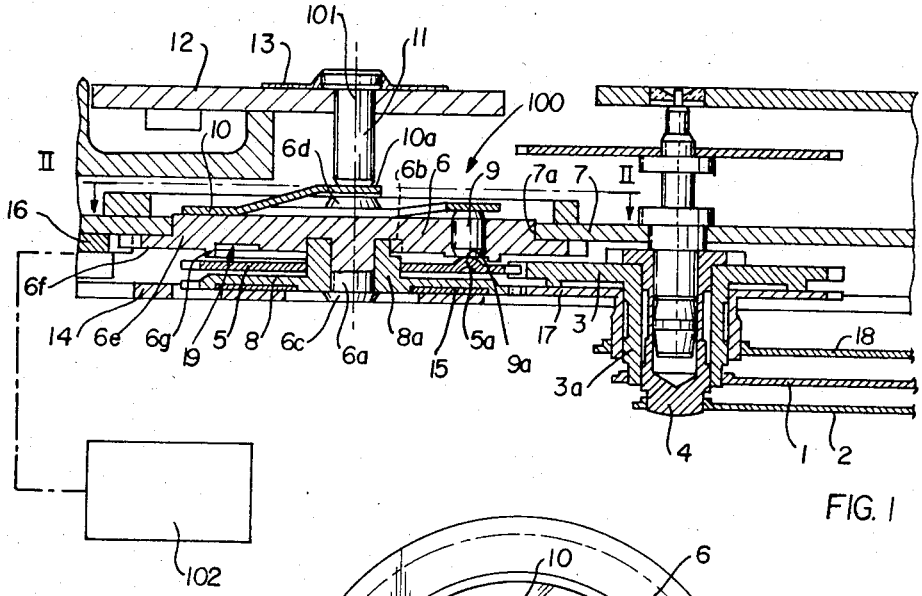
FIG. 1 is an axial section of a portion of an electronic alarm watch according to a first embodiment and in which only those elements that are necessary for the understanding of the invention have been shown.
Figure 2:
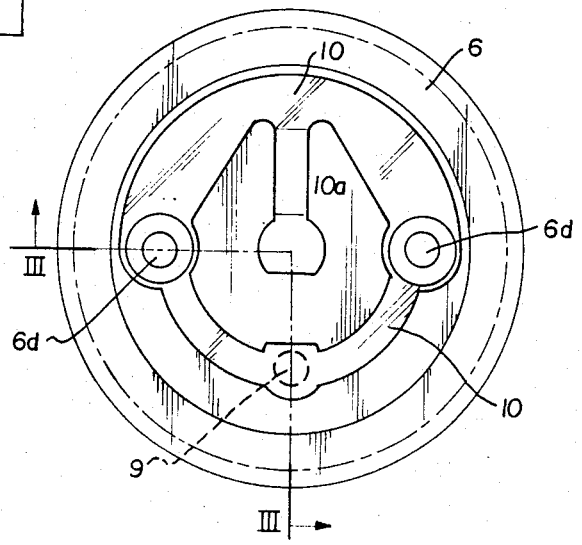
FIG. 2 is a partial plan view, on an enlarged scale, from the plane II—II of FIG. 1.
Figure 3:
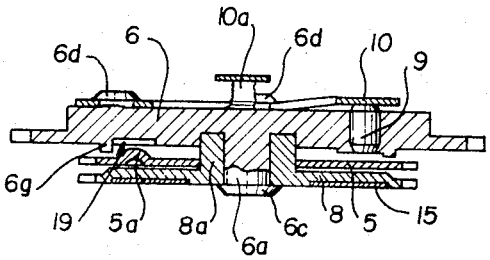
FIG. 3 is a vertical sectional view following the line III—III of FIG. 2.

The watch shown in FIGS. 1 to 3 is of the electromechanical type, the time-indicators being constituted by ordinary hour 1 and minute 2 hands which are movable in front of a dial (not shown). The hands 1 and 2 are carried, the former by the pipe 3*a* of the hour cannon wheel 3 and the latter by the center wheel 4. The electrical drive mechanism has not been shown, since it is known per se. It could be constituted by a stepping motor controlled by a quartz resonator via an adequate divider circuit. The energy will be supplied by an electric battery cell.

The hour cannon wheel 3 is meshed with an alarm wheel 5, made of steel and interposed with axial play between a toothed wheel 6 composed of an electrically insulating material and mounted for rotation in the plate 7 of the movement, and a metal wheel 8 coaxial with the said insulating wheel 6. The gear-ratio between the hour cannon wheel 3 and the alarm wheel 5 is 1:1 so that the alarm wheel makes one revolution every twelve hours as does the wheel 3. This gear ratio may advantageously be 1:2 so that the alarm wheel makes one revolution every twenty-four hours. The wheel 5 is grounded via the wheel 3 with which it is in permanent contact.

The insulating wheel 6 carries an electrically conductive contact member 9, in the form of a short cylinder or bar, the axis of which is parallel to that of the wheel 6 and the distance of which from the center corresponds to the distance from the center of an embossment 5*a* which is provided on the wheel 5 and is directed towards the insulating wheel 6. The alarm wheel 5 is freely mounted on a pipe 8*a* provided on the wheel 8 and through which extends an arbor 6*a* of the wheel 6. A detent 6*b* on the wheel 6 is engaged in a recess in the pipe 8*a* so that the wheels 6 and 8 are coupled for rotation with each other. They are held inseparably together by means such as a rivet head 6*c* on the end of the arbor 6*a*.

The wheel 6 carries, on the surface thereof opposite that which faces towards the alarm wheel 5, a thin metal washer 10 in the form of a ring fixed to the said wheel 6 by means of two studs 6*d* which are located diametrically opposite each other as shown in FIGS. 2 and 3.

The washer 10 has a radial arm 10*a* which extends inwardly and diverges obliquely from the general plane of the washer 10. The arm 10*a* bears resiliently against the end of a bolt 11 which is coaxial with the wheel 6 and is carried by a substrate of the printed circuit 12 of the watch. The bolt 11 is in electrical contact with one of the conductive tracks 13 of the substrate of the circuit 12. The resilient arm 10*a* on the ring 10, constituting a spring, urges the integral assembly formed by the wheel 6 and the wheel 8 against a bridge-piece 14 of the framework of the movement of the watch. The wheel 8 is fitted with a ring 15 of anti-friction plastics material via which it bears against the bridge-piece 14. As a result, the bridge-piece 14 is subjected to a slight, resilient deformation, so that said bridge-piece constitutes a spring urging the assembly of wheels 6 and 8 against the plate 7 as explained hereafter.

The wheel 6 has, on the side thereof on which it carries the washer 10 a cylindrical part 6*e* which is engaged substantially without play in a circular opening 7a of corresponding diameter formed in the plate 7. The cylindrical part 6e is followed by a part 6f of greater diameter which is formed with teeth on its periphery and serves as an axial abutment cooperating with the plate 7.

Thus, the wheel 5 and the wheels 6 and 8 provided with the elements 6a, 8a and 10 constitute a sub-assembly or module 100. The module 100 comprises a mechanically unitary and inseparable assembly, formed of the elements 6, 8, 6a and 8a, which is mounted for rotation about an axis 101 in the framework 7, 14 of the watch. The axis 101 coincides with that of the wheels 5, 6 and 8. The wheel 5 is mounted rotatably and with axial play on the said unitary assembly 6, 8, 6a, 8a. The axis 101 is spaced apart from and parallel to the axis of rotation of the hands 1, 2.

During assembly of the watch, the module 100 is first positioned with the part 6e fitted in the opening 7a in the plate 7. Then the bridge-piece 14 is fixed in the position shown in FIG. 1, a position in which it urges the part 6f against the plate 7 and in which the arm 10a is resiliently deformed against the bolt 11.

The toothed part 6f of the wheel 6 meshes with a control pinion 16 which can be operated manually by means of an operating mechanism 102, known per se, which enables the angular position of the said unitary assembly 6, 8, 6a, 8a to be adjusted manually. The wheel 8 is in mesh with a supplementary cannon wheel 17 which is rotatably mounted on the pipe 3a of the cannon wheel 3. The wheel 17, which is coaxial with the wheel 3 has a pipe 17a on which is mounted a so-called alarm hand 18 that provides an analog indication of the time for which the alarm is set.

The insulating wheel 6 has, on the surface thereof which faces towards the alarm wheel 5, an annular rib 6g which is coaxial with the wheel 6 and the distance of which from the center is greater than that of the member 9. An arcuate groove 19 thus is formed in the surface of the wheel 6 and is suitably dimensioned so that the embossment 5a of the wheel 5 is out of contact with the wheel 6 in all relative angular positions of the wheels 5 and 6 in which the embossment 5a is located otherwise than opposite the member 9. This groove is connected by means of two inclined surfaces (not shown) with the flat end surface 9a presented by the member 9 at the end thereof which is directed towards the wheel 5. This end surface 9a is set back with respect to the free edge of the rib, so that the wheel 5 does not enter into contact with the member 9 when this latter is not opposite the embossment 5a. However, the set-back of the end surface 9a with respect to the free edge of the rib 6g is sufficiently slight to allow the embossment 5a to enter into contact with the said surface 9a when the contact members 5a, 9a are opposite each other. In the example shown in FIGS. 1 to 3, the contact member 9 is a bar-type permanent magnet.

Figure 4:
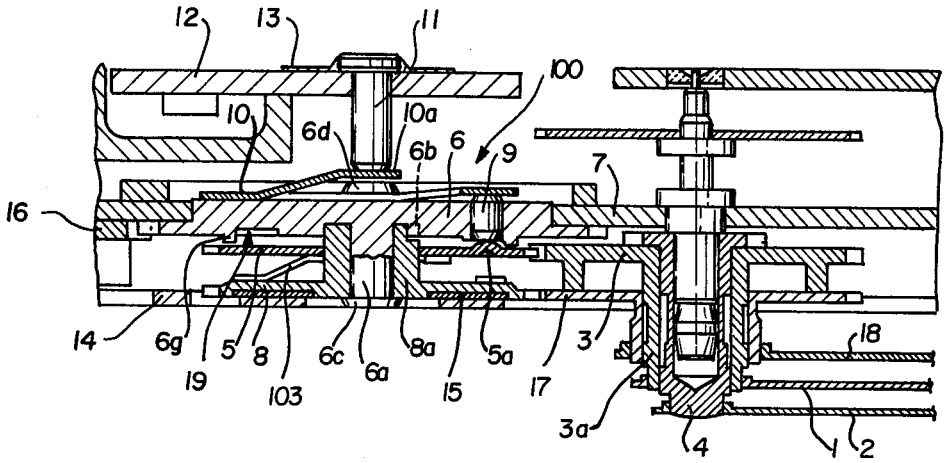
FIG. 4 is a view similar to FIG. 1, showing a second embodiment of the invention.

According to FIG. 4, in which parts that are the same as or analogous to those of FIG. 1 bear the same references, the contact member 9 is a simple metal element made of copper. In this case, a spring in the form of a non-flat washer 103 is interposed between and bears against the wheel 8 on the one hand and the wheel 5 on the other hand.

The contact between the embossment 5a and the member 9 grounds the latter, since the wheel 5 is itself grounded, which, via the washer 10 and the bolt 11 grounds the conductive track 13. An electrical circuit thus closed controls the commencement of operation of an alarm striking mechanism (not shown).

From the foregoing description, the operation of the alarm actuating mechanism according to the invention will be clear to those skilled in the art. To set the alarm time, the user actuates the mechanism 102, causing the pinion 16, the toothed wheel 6, the metal wheel 8, and the supplementary cannon wheel 17 to rotate until the alarm hand 18 points to the desired alarm time on the face of the watch. The contact memeber 9 will thus be positioned in accordance with the selected alarm time. Thereafter, the hour cannon wheel 3 will rotate the alarm wheel 5, causing the embossment 5a to move through the arcuate groove 19 until an inclined surface (not shown) in the groove 19 causes the embossment 5a to move axially slightly and into contact with the contact member 9. When the contact member 9 is magnetic, contact is ensured by magnetic attraction to the steel alarm wheel 5. When the contact member 9 is non-magnetic, the spring 103 forces the embossment 5a into contact with the contact member 9.

What is claimed is:

1. A timepiece comprising:

a framework;

means, rotatably mounted on said framework, for displaying the present time;

movement means mounted on said framework for actuating said means for displaying;

modular alarm activating means, rotatably mounted on but removable as a module from said framework, for closing an electric contact at a time which can be set in advance, said modular activating means comprising a first support member mounted on said framework for rotation about a first axis, a first electrical contact member mounted on said first support member for rotation therewith about said first axis, a second support member mounted on and about said first support member for rotation about said first axis relative to said first support member, said second support member being operatively connected to said movement means, a second electrical contact member mounted on said second support member for rotation therewith about said first axis, said second contact member being in position to be rotated into contact with said first contact member to activate an alarm and means for inseparably holding said second support member on said first support member to permit removal of said alarm activating means as a module from said framework; and means mounted on said framework for rotating said first support member of said modular activating means to position said first contact member at a location corresponding to a desired alarm time, whereby said first and second contact members are brought into contact when said support member has been rotated by said movement means until said second contact member reaches said location corresponding to said desired alarm time.

2. A timepiece according to claim 1, wherein said means for displaying the present time is mounted on said framework for rotation about a second axis spaced apart from said first axis.

3. A timepiece according to claim 1, further comprising means for bringing said first and second contact members into contact when said contact members are positioned opposite one another.

4. A timepiece according to claim 3, wherein said bringing means comprises a spring biasing said second support member along said first axis toward said first support member.

5. A timepiece according to claim 1, wherein said movement means comprises a first toothed wheel mounted for rotation on said framework and a pipe mounted coaxially on said first toothed wheel; said means for displaying comprises an hour hand mounted on said pipe; and said second support member comprises a second toothed wheel meshed with said first toothed wheel.

6. A timepiece according to claim 1, further comprising a first toothed wheel mounted for rotation on said framework, a pipe mounted coaxially on said first toothed wheel and an alarm time hand mounted on said pipe; and said first support member comprises a second toothed wheel meshed with said first toothed wheel.

7. A timepiece comprising:

a framework having a circular opening;

means, rotatably mounted on said framework, for displaying the present time;

movement means mounted on said framework for actuating said means for displaying;

modular alarm activating means, rotatably mounted on but removable as a unit from said framework, for closing an electric contact at a time which can be set in advance, said modular activating means comprising a first toothed wheel having a cylindrical portion extending from one side thereof into said circular opening to rotatably support said modular alarm activating means in said framework for rotation about a first axis, a first electrical contact member mounted for rotation with said first toothed wheel, a second toothed wheel connected to said first toothed wheel, said second toothed wheel having a pipe engaged with the other side of said first toothed wheel so that said first and second toothed wheels rotate together about said first axis, a support member mounted unseparably on said pipe for rotation about said first axis, said support member being operatively connected to said movement means, and a second electrical contact member mounted for rotation with said support member in position to be rotated into contact with said first contact member to activate an alarm; and means mounted on said framework for rotating said first toothed wheel of said modular activating means to position said first contact member at a location corresponding to a desired alarm time, whereby said first and second contact members are brought into contact when said support member has been rotated by said movement means until said second contact member reaches said location corresponding to said desired alarm time.

8. A timepiece according to claim 7, further comprising means mounted on said framework and engaged with said second toothed wheel for displaying said desired alarm time.

9. A timepiece according to claim 7, wherein said second toothed wheel comprises antifriction means on its side opposite to said pipe for bearing against said framework.

10. A timepiece according to claim 9, wherein said first toothed wheel comprises an arbor extending through said pipe of said second toothed wheel and a head on the end of said arbor engaging said second toothed wheel.

11. A timepiece according to claim 7, further comprising spring means, positioned between said second toothed wheel and said support member, for bringing said first and second contact members into contact when said contact members are positioned opposite one another.

12. A timepiece according to claim 7, wherein said support member also is mounted for axial movement on said pipe.

13. A timepiece according to claim 7, wherein said cylindrical portion of said first toothed wheel is made of electrically insulating material contacting said framework.

* * * * *